United States Patent [19]

Perrot

[11] Patent Number: 5,071,023

[45] Date of Patent: Dec. 10, 1991

[54] DEVICE FOR MANUALLY OPENING AND CLOSING A VESSEL DOOR

[75] Inventor: Yvan Perrot, Arbois, France

[73] Assignee: Societe Nouvelle Clera, Chateaurenard, France

[21] Appl. No.: 578,804

[22] Filed: Sep. 7, 1990

[30] Foreign Application Priority Data

Sep. 8, 1989 [FR] France ..... 89 12002

[51] Int. Cl.[5] ..... B65D 45/00; B65D 45/16; B65D 45/24

[52] U.S. Cl. ..... 220/318; 220/315; 220/324; 220/326; 220/335

[58] Field of Search ..... 220/315, 318, 352, 331, 220/333, 335, 324, 326; 292/123

[56] References Cited

U.S. PATENT DOCUMENTS

| | | | |
|---|---|---|---|
| 493,145 | 3/1893 | Ames | 220/263 |
| 575,708 | 1/1897 | Dorrance | 220/263 |
| 796,264 | 8/1905 | Steubner | 220/263 X |
| 2,929,128 | 3/1960 | White | 220/315 X |
| 3,283,944 | 11/1966 | Richardson | 220/315 X |
| 4,853,985 | 8/1989 | Perry | 220/331 X |

*Primary Examiner*—Stephen Marcus
*Assistant Examiner*—Paul Schwarz
*Attorney, Agent, or Firm*—Dowell & Dowell

[57] ABSTRACT

A device for manually opening and closing a vessel door the device including a fixed first bar and a moveable second bar mounted parallel to the first bar which when moved toward the first bar, permits relative movement of the door and insures automatic locking of the door in both open and close positions.

2 Claims, 4 Drawing Sheets

DEVICE FOR MANUALLY OPENING AND CLOSING A VESSEL DOOR

BACKGROUND OF THE INVENTION

The present invention relates to a manual device for opening and closing a door of a vessel, such as a rotating vessel for deburring workpieces.

HISTORY OF THE RELATED ART

It is known that manual devices for opening or closing doors of vessels are difficult and fastidious to use and their production is generally complicated. Moreover, certain risks exist for the operator when a door is in an open position, as it happens that the door closes under the effect of its own weight.

SUMMARY OF THE INVENTION

The present invention intends to overcome the aforementioned drawbacks, which invention has for its object a unique device for manual opening and closure defined in claim 1.

BRIEF DESCRIPTION OF THE DRAWINGS

The accompanying drawing, given by way of example, will enable the invention, the characteristics that it presents and the advantages that it may procure, to be more readily understood.

DESCRIPTION OF THE PREFERRED EMBODIMENT

Figure 1:
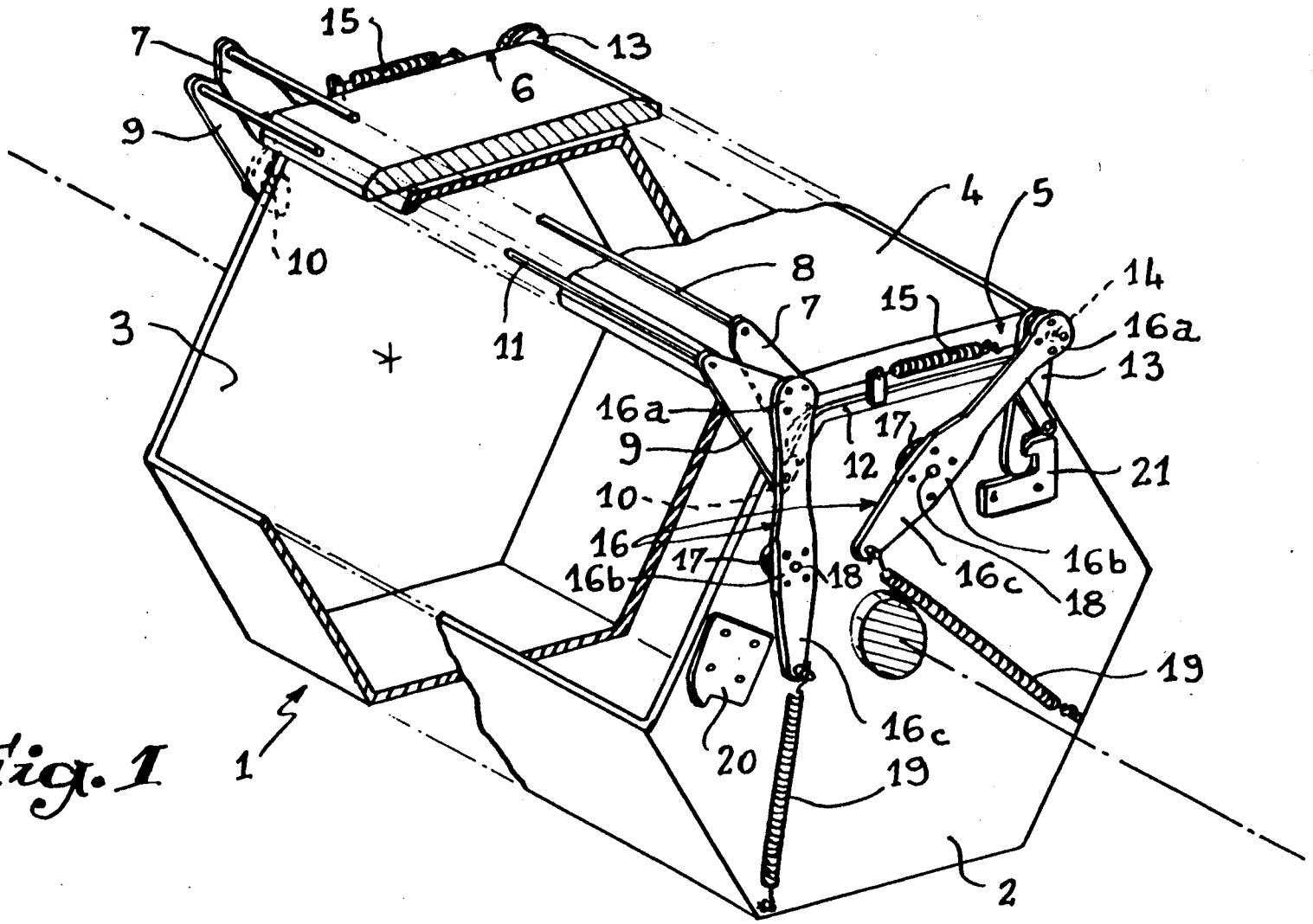
FIG. 1 is a view in perspective with portions broken away, showing the assembly of the elements of the device for opening and closing a vessel door according to the invention.
Figure 2:
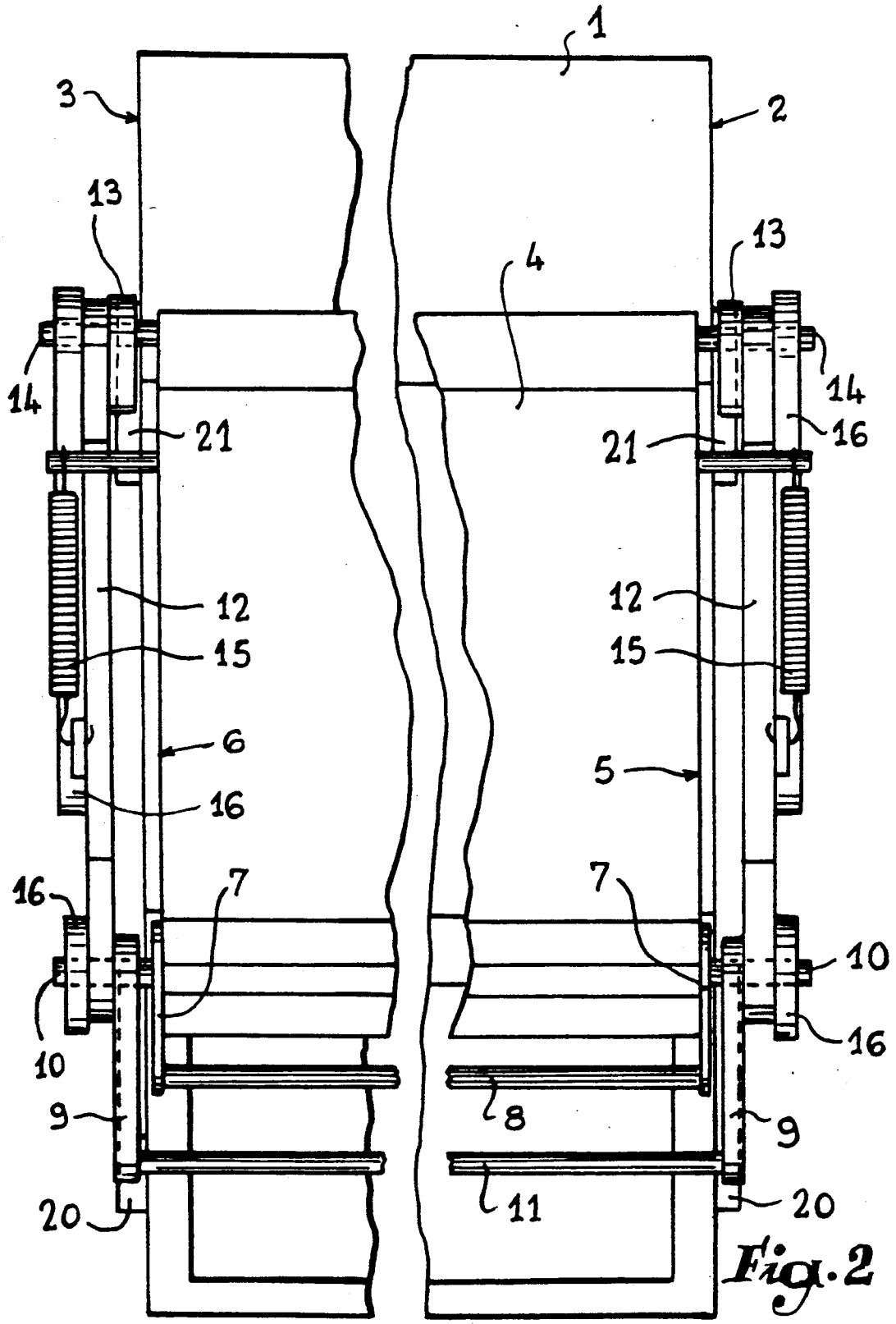
FIG. 2 is a plan view of the device of FIG. 1.
Figure 3:
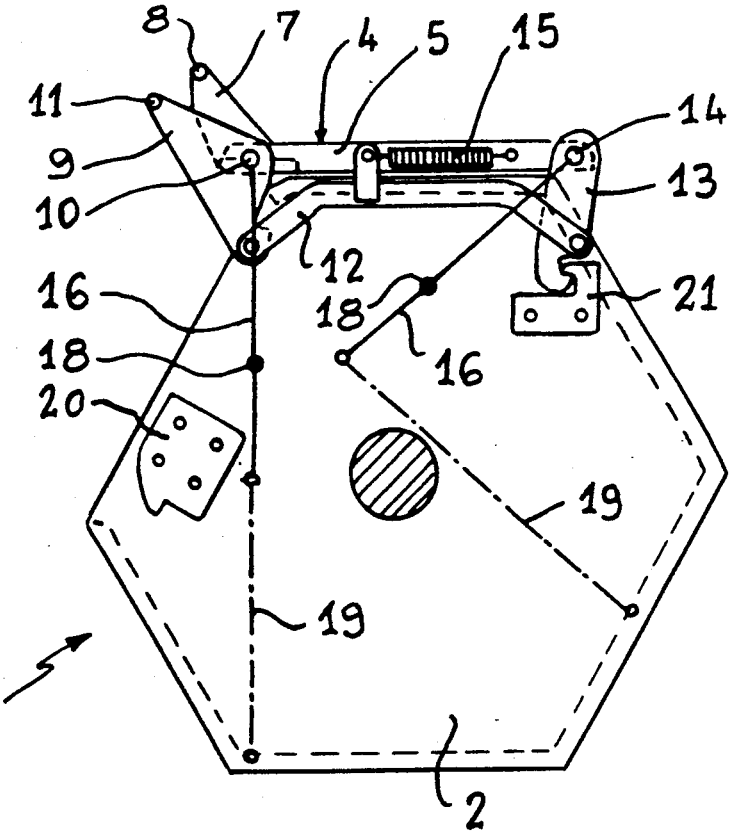
FIG. 3 is a schematic section of the device of FIG. 1 in locked open position.
Figure 4:
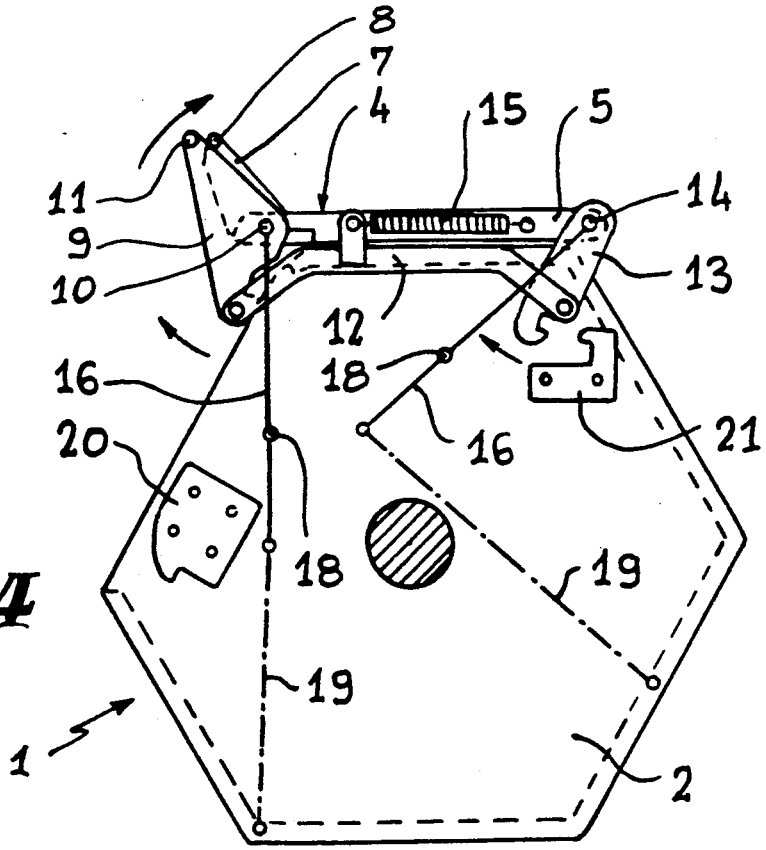
FIG. 4 is a section similar to that of FIG. 3, the door being shown in unlocked open position.
Figure 5:
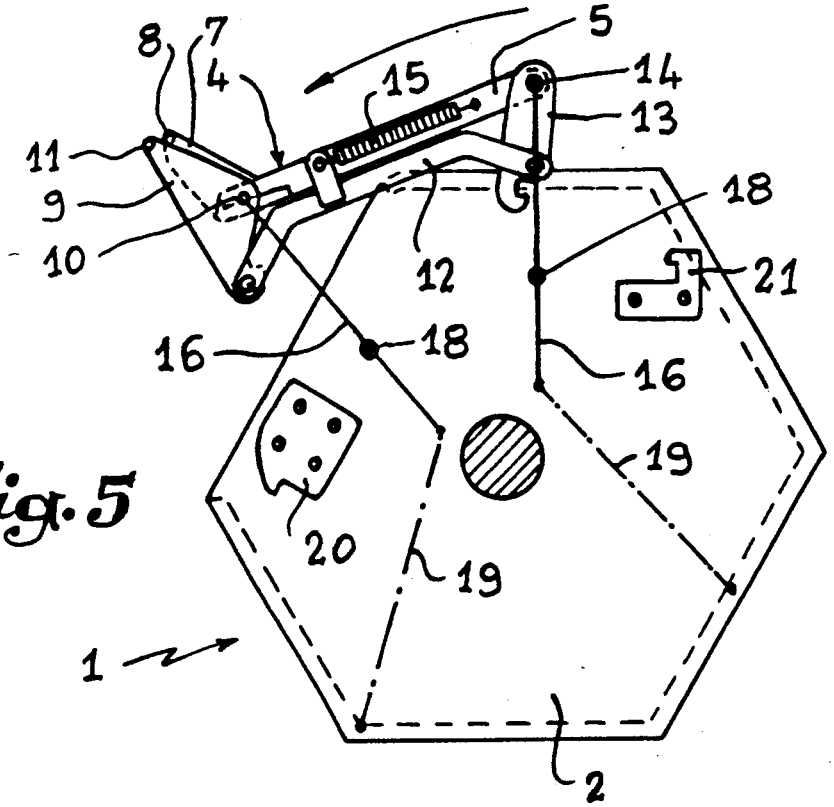
FIG. 5 is a schematic section of the device of FIG. 1 in intermediate position.
Figure 6:
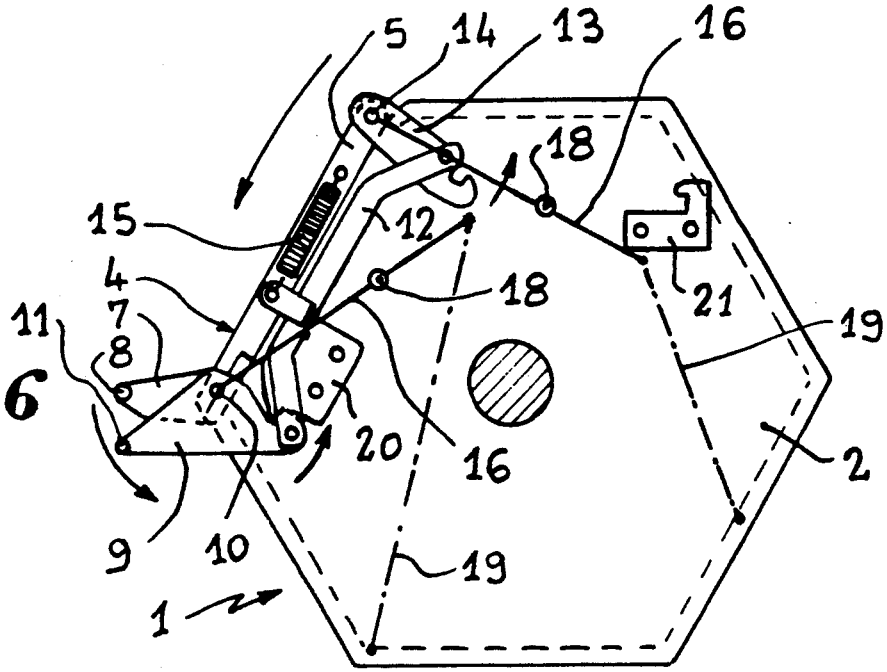
FIG. 6 is a section similar to FIG. 3, but in locked closed position.

FIGS. 1 and 2 show a rotating vessel 1 of hexagonal section, comprising on each of its lateral or side walls 2 and 3 two mechanisms, identical to each other, of a device for maneuvering and locking an access door 4.

In the front part of door 4 and on either side 5 and 6, are mounted two fixed supports 7 connected to each other by a longitudinal traction bar 8 which is disposed outside the door 4.

With each support 7 is associated a first hook 9 of triangular configuration, mounted on a pivot pin 10 carried by the support 7. The two hooks 9 are joined by a bar 11 disposed parallel to the traction bar 8.

Each of the hooks 9 is secured with a small rod 12 connected to a second hook 13 disposed the rear part of the door 4 on a pin 14. The two rods 12 are urged in translation by traction springs 15 provided on each side 5 and 6 of the door 4.

On each side of the vessel, are provided two levers 16 which are secured, on the one hand, to door 4 at their outer ends **16*a*, cooperating with the pins 10, 14 and thus covering the hooks 9, 13 and, on the other hand, to vessel 1 by a central part 16*b*, which is provided with a bearing 17 which pivots on a pin 18 provided on the corresponding lateral wall 2 or 3 of the vessel 1. The free end 16*c* of each of the levers 16 is coupled to a spring 19 secured on the corresponding lateral wall 2 or 3, making it possible to compensate for the weight of the door 4** during its movements of opening and of closing.

In addition, on the lateral walls 2 and 3 are disposed hooked stops 20 and 21 sectioned to cooperate with the hooks 9 and 13 to retain the door 4 in its position.

FIGS. 3, 4, 5 and 6 show the movement made by the door 4 during its passage from a locked open position to a locked closed position.

The operator proceeds in the following manner:

he or she brings the bar 11 closer to the traction bar 8 in order to hold the two bars together;

they thus displace the mobile hooks 9 towards the fixed supports 7, with the result that the rods 12 connected to the traction springs 15 move themselves parallel to the sides 2 and 3 of the vessel 1 in order to release the second hooks 13 from their fixed stops 21 with which they cooperated;

they then grip both the traction bar 8 and the bar 11 in order to pivot the door 4 about the axes 18 of levers 16 to take it to its closed position;

they release the bar 11 supported by the mobile hooks 9 which, under the effect of the traction springs 15 and via rods 12, are brought into contact with the stops 20, locking the door 4 in the closed position.

It should be observed that the springs 15 associated with the rods 12 intervene at the end of the movement of opening and of closing of the door 4 to automatically ensure locking of the door after it is moved.

I claim:

1. A device for manually opening and closing a vessel door which is moveable with respect to opposing sidewalls of the vessel in which the sidewalls have front and rear portions and the door has opposite sides characterized in that the device insures automatic locking of the door both in open and closed positions comprising, a traction bar mounted to the door, a locking means, said locking means including two pairs of first and second pivoting hooks, one pair mounted on each side of the door, said first and second pivoting hooks being adapted to cooperate with a pair of first and second hooked stops secured to each vessel sidewall adjacent said front and rear portions thereof respectively, each pair of said first and second pivoting hooks being connected by a separate rod associated with elastic means, said first pivoting hooks disposed along said opposite sides of the door being connected to one another by a bar, said bar being oriented parallel to said traction bar fixed to said door whereby the relative movement of said bar toward said traction bar releases each of said first and second pivoting hooks from said stops to permit the relative movement of the door.

2. The device for manually opening and closing a vessel of claim 1 in which the door is connected to the vessel by two pairs of first and second articulated levers, means for pivotally attaching said first and second levers to opposite sidewalls of the vessel, each of said first and second levers having first and second ends, said first ends of said articulated levers being connected to said first and second pivoting hooks, and spring means connected to said second ends of said articulated levers whereby said spring means compensate for the weight of the door during its movement from an open to closed positions.

* * * * *